United States Patent [19]

Wengenroth et al.

[11] Patent Number: 4,635,512

[45] Date of Patent: Jan. 13, 1987

[54] APPARATUS FOR THE CUTTING OF RODS, ESPECIALLY CONCRETE REINFORCING RODS

[75] Inventors: Kurt Wengenroth, Wuppertal; Siegfried Klaus, Ennepetal, both of Fed. Rep. of Germany

[73] Assignee: Carl Ulrich Peddinghaus, Wuppertal-Barman, Fed. Rep. of Germany

[21] Appl. No.: 695,123

[22] Filed: Jan. 25, 1985

[30] Foreign Application Priority Data

Jan. 26, 1984 [DE] Fed. Rep. of Germany ..... 3402567

[51] Int. Cl.[4] ..... B21D 43/12; B21D 43/28

[52] U.S. Cl. ..... 83/156; 83/157; 83/385; 83/373

[58] Field of Search ..... 83/276, 277, 156, 157, 83/81, 82, 694, 436, 378, 382, 385, 386, 373

[56] References Cited

U.S. PATENT DOCUMENTS

| | | | |
|---|---|---|---|
| 3,886,828 | 6/1975 | Muller | 83/156 X |
| 4,485,707 | 12/1984 | Tsuge et al. | 83/156 X |
| 4,524,659 | 6/1985 | Yunoki | 83/156 X |

FOREIGN PATENT DOCUMENTS

| | | | |
|---|---|---|---|
| 3038092 | 5/1982 | Fed. Rep. of Germany . | |
| 3300940 | 4/1984 | Fed. Rep. of Germany . | |
| 366441 | 2/1963 | Switzerland | 83/384 |

*Primary Examiner*—James M. Meister
*Assistant Examiner*—John L. Knoble
*Attorney, Agent, or Firm*—Karl F. Ross; Herbert Dubno

[57] ABSTRACT

A shear for cutting a stock between a feed conveyor and a discharge conveyor has a pair of rollers which can engage the stock when the movable blade is in its upper position, the slide having a stroke equal to the distance by which the discharge conveyor is located below the feed conveyor.

6 Claims, 2 Drawing Figures

APPARATUS FOR THE CUTTING OF RODS, ESPECIALLY CONCRETE REINFORCING RODS

FIELD OF THE INVENTION

Our present invention relates to an apparatus for the cutting of rods and, more particularly, for the cutting of concrete reinforcing rods or so-called rebar.

BACKGROUND OF THE INVENTION

In a rolling mill for producing concrete concrete reinforcing bar or at a site at which concrete reinforcing rod is to be cut into shorter lengths and, more generally, wherever bar-like stock may have to be severed into lengths, it is convenient to provide rod shears for this purpose.

Consequently, it is known to provide an apparatus for the cutting of rod stock and especially concrete reinforcing rod, which comprises a conveyor for advancing the rod stock to the cutting site, a shear at the cutting site, and a conveyor downstream of the cutting site for discharging the cut lengths of stock from the apparatus. These three components can be mounted on a common or multipart machine frame or structure. In general, the feed conveyor moves the rod stock in a feed plane, i.e. a horizontal plane through the axis of the bar stock which is located by about half the diameter of the stock above the fixed lower blade of the shear.

Consequently, the shear has a lower blade which is fixed, sometimes referred to as a counter blade, and a movable upper blade which is carried by a slide or carriage and which is spaced above the lower blade to allow the rod stock to pass, and then driven downwardly by conventional means, e.g. an excentric or crank or even a hydraulic or pneumatic driver, to sever the length of stock from the feed.

The stroke, of the upper blade, i.e. the cutting stroke generally is somewhat in excess of the diameter of the rod and is usually in the vertical direction.

Such apparatus can be provided with automatic controls for, for example, measuring the length of stock fed past the shear and then triggering the shear when the desired length has been measured, to cut the stock accurately into respective lengths.

A conventional apparatus of this type has been illustrated and described in German patent document Open Application DE OS No. 30 38 082, that apparatus having no elements which are provided on the shear slide or on the shear bed to cooperate with the feed conveyor to stabilize the depositing of the cut length upon the latter. In this system the discharge plane of the discharge conveyor, i.e. the plane through the center of the rod when the rod lies on the discharge conveyor, coincides with the feed plane.

This arrangement has certain disadvantages. For example, during the cutting process, substantial force may be applied to the rod length which is being severed from the oncoming stock so as to disorient or dislocate this length. The stock then has to pass onto the discharge conveyor and may even be incapable of being reoriented automatically by this conveyor for proper displacement.

Problems are also encountered when pressing rollers form part of the discharge conveyor and engage a leading portion of a cut length of stock. High level disorientation or deflection of the stock can cause damage to the apparatus.

This problem has been recognized and German Pat. No. 33 00 940, for example, has especially designed a conveyor to prevent uncontrolled shifting of the rod material. This is not always successful.

Mention should also be made of the fact that the uncontrolled handling of the rod material may make the subsequent bundling of the rod material, as is often desired, impractical or impossible.

OBJECTS OF THE INVENTION

It is, therefore, the principal object of the present invention to provide an improved rod cutting apparatus whereby the disadvantages previously outlined are avoided.

Another object of this invention is to provide an apparatus for cutting rod and bar stock which maintains the orientation of the stock before, during and after cutting more successfully then has heretofore been the case so that uncontrolled charges in the orientation of the stock do not occur.

It is yet another object of this invention to improve upon the cutting rate of an apparatus for the cutting of bar or rod stock, generally by precluding shifting of the stock on or after cutting, thereby eliminating the reduction in speed which results from such disorientation of the stock.

SUMMARY OF THE INVENTION

These objects are attained, in accordance with the invention, in a rod-cutting apparatus which is provided with support means extending along a transport path for rod stock, especially concrete reinforcing rod, a feed conveyor on the support means at an upstream location along this path for feeding the rod stock, a shear having a fixed lower blade and a carriage carrying a movable upper blade downstream of the feed conveyor along this path, the carriage being reciprocable so that the upper blade will shear the stock against the lower blade, and a discharge conveyor on the support means downstream of the shear.

According to the invention, the shear carriage is provided, between the blades and the downstream or discharge conveyor, with at least one support roller while the conveying plane of the discharge conveyor is located by distance of about the length of the stroke of the movable blade below the feed plane so that a length of the rod as it is severed by the blade can rest upon the roller and be lowered thereon to the level of the discharge conveyor plane for travel in a feed direction.

The slide or carriage, moreover, is provided with a pressing roller disposed above the support roller for retaining the cut end of the rod thereagainst. Consequently, the advancing rod is fixed in position between the rollers of the slide until the slide is lowered thereby moving the cut end downwardly onto the discharge conveyor and into the plane thereof.

According to a preferred embodiment of the invention, at least one of these rollers is driven to facilitate advance of the stock and, if desired, the cut length of rod onto the discharge conveyor.

Consequently, the rollers not only define the position of the trailing end of the rod as it is cut but also serves for the controlled advance of the cut length and, prior to the cut, of the advancing stock.

One of the advantages of this system is that it can ensure advance of the rod stock by driving the cut end thereof even if the leading end of the rod has not yet been engaged by the conveyor.

In the embodiment of the invention using driven pressing rollers, it is possible to drive the pressing roller with a chain drive synchronously driven and advantageously coupled with the drive for the feed conveyor.

Advantageously, the pressing roller is mounted so as to swing on the aforementioned carriage, the swing of the pressing roller being controllable to increase or decrease the force with which the two rollers grip the rod between them.

The principal advantage of this apparatus is that it ensures a high pressing retention of the rod as it is engaged by the discharge conveyor so that uncontrolled orientation changes and the disadvantages accompanying them are completely avoided The system of the invention, therefore, can operate much more rapidly.

BRIEF DESCRIPTION OF THE DRAWING

The above and other objects, features and advantages of the present invention will become more readily apparent from the following description, reference being made to the accompanying diagrammatic drawing, in which.

SPECIFIC DESCRIPTION

Figure 1:
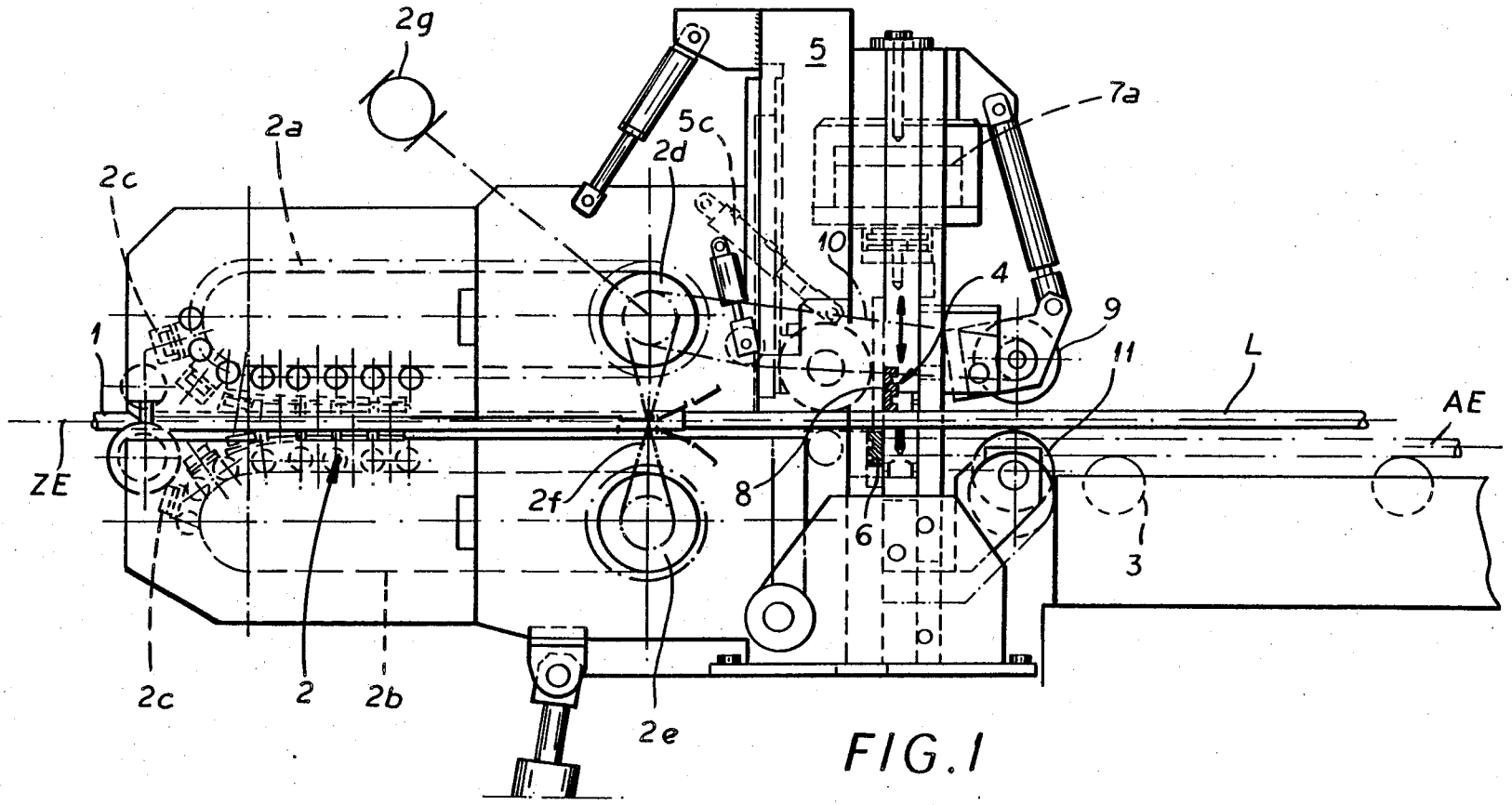
FIG. 1 is a schematic side-elevational view of a cutting apparatus according to the invention.
Figure 2:
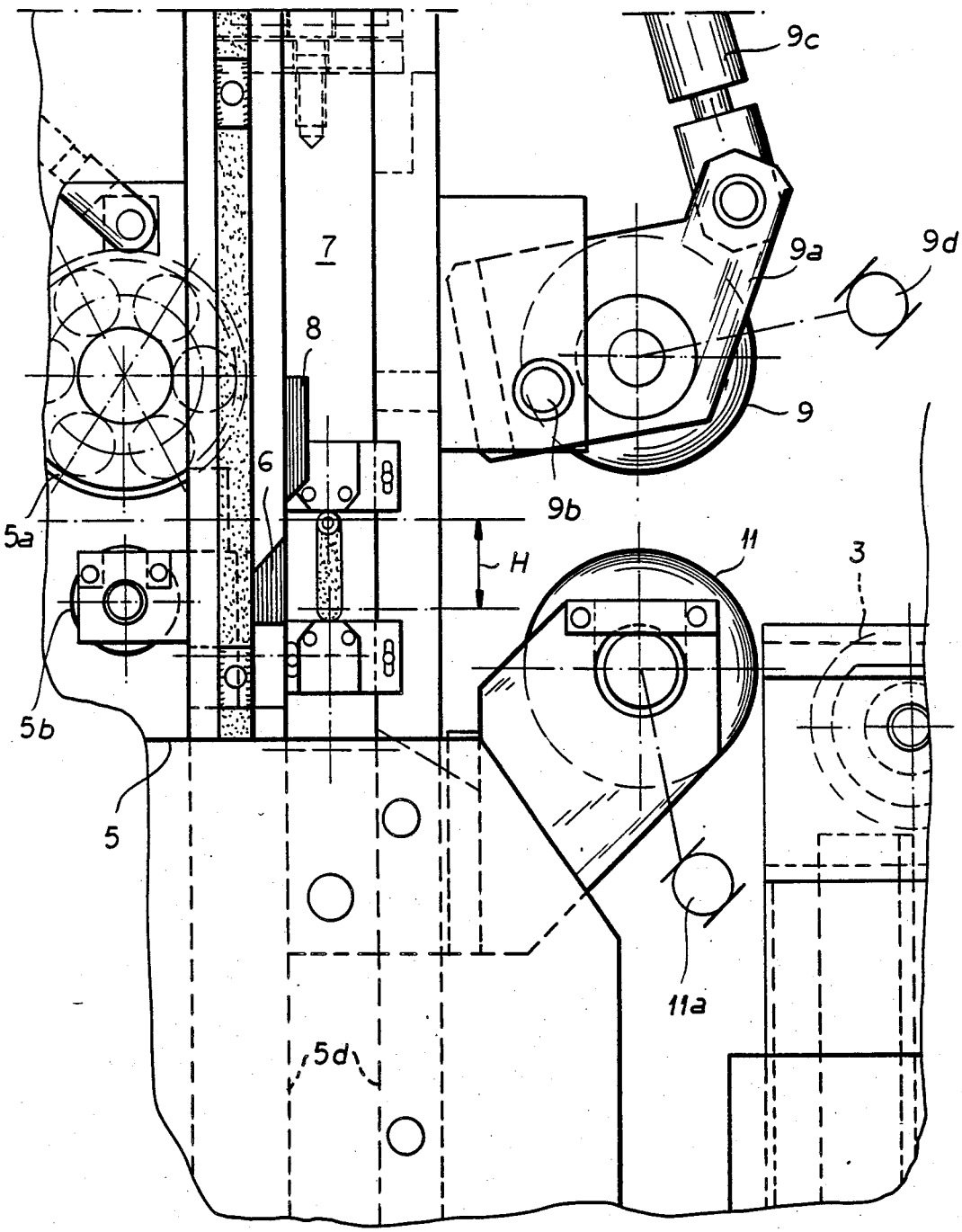
FIG. 2 is a detail view showing the mounting of the two rollers.

From FIGS. 1 and 2, it will be apparent that an apparatus for the cutting of rod material, i.e. rod stock of the type used for concrete reinforcing rod and arriving in a continuous rolled stock product as seen at 1 in FIG. 1, comprises a feed conveyor 2 mounted upon a machine frame generally seen at 5 and of which only the portions pertinent to the present invention have been shown or described in any detail.

The conveyor 2 can comprise a plane of endless belts *2a, 2b* with spaced apart shoes *2c* on each belt, the belts passing over rollers at either end of which only the motor driven roller *2d* and *2e* at the right hand end are visible. These belts are synchronously coupled by a belt *2f* so that a motor *2g* driving the roller *2d* will also synchronously drive the roller *2e* in the opposite sense.

Each of the shoes is concave towards the rod so as to receive the rod in the resulting pocket.

Downstream of the feed conveyor 2 is a separating shear 4 and downstream of the separating shear 4, we can provide a discharge conveyor here shown at 3 and represented by a plurality of spaced apart rollers.

The shear 4 (see FIG. 2) comprises a stationary counter blade 6 which is fixed in the frame 5 immediately downstream of a plane of guide rollers *5a* and *5b* which, for a given rod diameter, are fixedly located during a succession of cutting cycles. The rollers 5 and *5a* can be raised and lowered by a mechanism shown at *5c*, i.e. a hydraulic jack or piston-and-cylinder arrangement to raise this roller when a new length of rod is fed toward the blades.

The shear 4 also comprises a vertically displaceable shear carriage 7 guided in rails *5d* of the support frame and actuated by a fluid cylinder which has been represented diagrammatically at *7a* so as to have a vertical stroke with a throw H. The slide or carriage 7 is provided with a movable blade 8.

The feed conveyor 2 advances the rod stock 1 in a feed conveyor plane ZE seen as extending horizontally through the center or axis of the rod stock.

The discharge conveyor 3 draws off the cut stock or lengths in a discharge conveyor plane AE also designated by dot-dash lines.

The fixed blade 6 lies below the feed plane but above the discharge plane and the stroke of the slide 7 and of the blade 8 can be equal to the difference in levels, i.e. the stroke H previously mentioned.

The boundaries of the carriage have been shown in heavier lines in FIG. 2 for clarity.

On its side downstream from the blades 6, 7, the carriage or slide 7 is provided with at least one support roller 11 which, of course, moves up and down with the slide and which is positioned to receive a cut length of rod or a length of rod about to be cut while the slide is in its upper position and the rod is still in its feed plane. In this case, the feed plane or the plane of the underside of the rod resting upon the support roller 11 is tangent to this support roller in its upper position. This roller may have a peripheral groove complementary to the curvature of the rod.

Above the support roller 11, a peripheral groove pressing roller 9 is provided, the pressing roller 9 being journaled on a bracket *9a* which is pivotally secured at *9b* to the slide 7. A hydraulic or pneumatic piston or cylinder arrangement *9c* can be provided to raise and lower the roller 9 with respect to roller 11.

In operation, the rod stock as can be seen in FIG. 1 is about to be cut by a downward movement of the blade. Consequently, a length L of the stock has been advanced by the conveyor 2 over the lower blade 6 and is supported by the lower rollers 11 above the discharge conveyor 3. As the slide 4 moves downwardly to cut through the stock, the roller 9 is swung about the pivot *9b* to clamp the rod between the two rollers 9 and 11. The roller 9, moreover, is driven by a chain drive represented at 10 from the conveyor roller *2d* (FIG. 1) so that when the cut s completed and the cutting movement has simultaneously lowered the rod to the dot-dash position at the right of FIG. 1 onto the conveyor 3, the rollers 9 and 11 may assist in displacing the rod to the right.

Alternatively, individual motors which are synchronized with one another can drive the rollers 1 and 11 as represented at *9c* and *11a* in FIG. 2. In any event the drive for the rollers 9 and/or 11 can be synchronized with the conveyors 2 and 3.

In the drive embodiment shown in FIG. 1, the roller 9 may clamp the rod L against the roller 11 and be driven to assist in stablely advancing the rod through the shear prior to the cut.

The conveyor 3 is preferably a roller conveyor while the conveyor 2 is preferably a conveyor of the type shown and described in German Pat. No. 33 00 940.

We claim:

1. A rod cutting apparatus comprising:

support means forming a horizontal transport path for rod stock having an upstream side and a downstream side;

a feed conveyor at said upstream side of said support means for advancing said stock along said path in a horizontal feed plane;

a shear on said support means downstream of said feed conveyor comprising a lower blade disposed beneath said feed plane, a vertically displaceable carriage, and a movable blade mounted on said carriage and engageable with said stock for severing same, said movable blade and said carriage having a given cutting stroke;

a discharge conveyor downstream of said shear and having a discharge conveyor plane located below said horizontal feed plane by a distance substantially equal to said stroke;

a support roller mounted on a side of said carriage turned toward said discharge conveyor and, in an upper position of said carriage, lying so that it engages said stock as advanced by said feed conveyor in said feed plane, said stock being engaged from below by said support roller and being substantially tangent to a surface of said support roller so that upon displacement by said carriage through said stroke, stock lying on said support roller is displaced into said discharge conveyor plane; and a pressing roller mounted on said carriage and displaceable toward and away from said support roller for engaging said stock between said support roller and said pressing roller.

2. The apparatus defined in claim 1, further comprising means for driving at least one of said rollers.

3. The apparatus defined in claim 2 wherein said means for driving at least one of said rollers includes a drive substantially coupling said pressing roller with said feed conveyor.

4. The apparatus defined in claim 3 wherein said drive is a chain drive.

5. The apparatus defined in claim 1, further comprising means on said carriage for lifting said pressing roller away from said support roller.

6. The apparatus defined in claim 1 wherein said discharge conveyor is a roller conveyor.

* * * * *